US012753953B2

(12) United States Patent
Sasano et al.

(10) Patent No.: US 12,753,953 B2
(45) Date of Patent: Oct. 6, 2026

(54) CRYOGENIC COOLING DEVICE

(71) Applicant: SUMITOMO HEAVY INDUSTRIES, LTD., Tokyo (JP)

(72) Inventors: Kadutoshi Sasano, Nishitokyo (JP); Syuji Sasazaki, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 246 days.

(21) Appl. No.: 18/780,370

(22) Filed: Jul. 22, 2024

(65) Prior Publication Data

US 2024/0377107 A1 Nov. 14, 2024

Related U.S. Application Data

(63) Continuation of application No. PCT/JP2022/046663, filed on Dec. 19, 2022.

(30) Foreign Application Priority Data

Jan. 31, 2022 (JP) ..... 2022-012803

(51) Int. Cl.
*F25B 9/10* (2006.01)
*F25B 9/02* (2006.01)

(52) U.S. Cl.
CPC ..... *F25B 9/10* (2013.01); *F25B 9/02* (2013.01); *F25B 2309/02* (2013.01)

(58) Field of Classification Search
CPC ..... F25B 2309/02; F25B 25/00; F25B 9/02; F25B 9/10; F25B 9/14
See application file for complete search history.

(56) References Cited

U.S. PATENT DOCUMENTS 4,829,785 A * 5/1989 Hersey ..... H01M 8/0656 62/335
4,854,131 A 8/1989 Sakitani et al.
8,844,298 B2 * 9/2014 Woidtke ..... F25D 19/006 62/51.1
11,125,663 B1 * 9/2021 Henslee ..... G01N 21/01
11,674,738 B2 * 6/2023 Dally ..... G01N 1/42 62/6
11,739,747 B2 * 8/2023 Son ..... F04B 39/0044 417/363
11,946,680 B2 * 4/2024 Tillemann-Dick ..... F25B 9/12
(Continued)

FOREIGN PATENT DOCUMENTS

JP S62268961 A 11/1987
JP H02103664 U 8/1990
(Continued)

*Primary Examiner* — Filip Zec
(74) *Attorney, Agent, or Firm* — HEA Law PLLC

(57) ABSTRACT

A cryogenic cooling device includes: a cooling system including a cryocooler that includes a precooling stage configured to cool a refrigerant, a cooling stage that is disposed to be separated from the precooling stage, and a refrigerant circulation circuit configured to cool the cooling stage with the refrigerant; a fixation portion that is fixed with respect to the precooling stage, is thermally coupled to the precooling stage, and is cooled by the precooling stage; and a cooling stage support member that connects the cooling stage to the fixation portion such that displacement of the cooling stage with respect to the fixation portion is allowed.

11 Claims, 3 Drawing Sheets

(56) References Cited

U.S. PATENT DOCUMENTS

| | | | | |
|---|---|---|---|---|
| 12,071,998 | B2 * | 8/2024 | Motley | F16F 15/06 |
| 2015/0168028 | A1 * | 6/2015 | Lei | F25B 9/10 62/6 |
| 2019/0226724 | A1 * | 7/2019 | Kotsubo | F25B 9/145 |
| 2024/0191913 | A1 * | 6/2024 | Nakano | F25B 9/145 |

FOREIGN PATENT DOCUMENTS

| | | | |
|---|---|---|---|
| JP | H04204280 | A | 7/1992 |
| JP | 2014044018 | A | 3/2014 |
| JP | 2014092300 | A | 5/2014 |
| JP | 2019078511 | A | 5/2019 |

* cited by examiner

CRYOGENIC COOLING DEVICE

CROSS-REFERENCE TO RELATED APPLICATIONS

This is a bypass continuation of International PCT Application No. PCT/JP2022/046663, filed on Dec. 19, 2022, which claims priority to Japanese Patent Application No. 2022-012803, filed on Jan. 31, 2022, which are incorporated by reference herein in their entirety.

BACKGROUND

Technical Field

Certain embodiments of the present invention relate to a cryogenic cooling device.

Description of Related Art

The related art discloses a refrigerant circulation type cryogenic cooling device having a cooling stage. The cooling stage and a cryocooler are coupled to each other by a refrigerant circulation circuit, and the cooling stage is cooled by a refrigerant cooled by the cryocooler. In this case, for example, the cryocooler may be a Gifford-McMahon (GM) cryocooler, and the refrigerant circulation circuit may be a JT circuit having a Joule-Thomson (JT) valve. The cooling stage can be physically connected to an object to be cooled, such as superconducting equipment, and can cool the object to be cooled via conduction cooling.

SUMMARY

According to an embodiment of the present invention, there is provided A cryogenic cooling device including: a cooling system including a cryocooler that includes a precooling stage configured to cool a refrigerant, a cooling stage that is disposed to be separated from the precooling stage, and a refrigerant circulation circuit configured to cool the cooling stage with the refrigerant; a fixation portion that is fixed with respect to the precooling stage, is thermally coupled to the precooling stage, and is cooled by the precooling stage; and a cooling stage support member that connects the cooling stage to the fixation portion such that displacement of the cooling stage with respect to the fixation portion is allowed.

DETAILED DESCRIPTION

Figure 1:
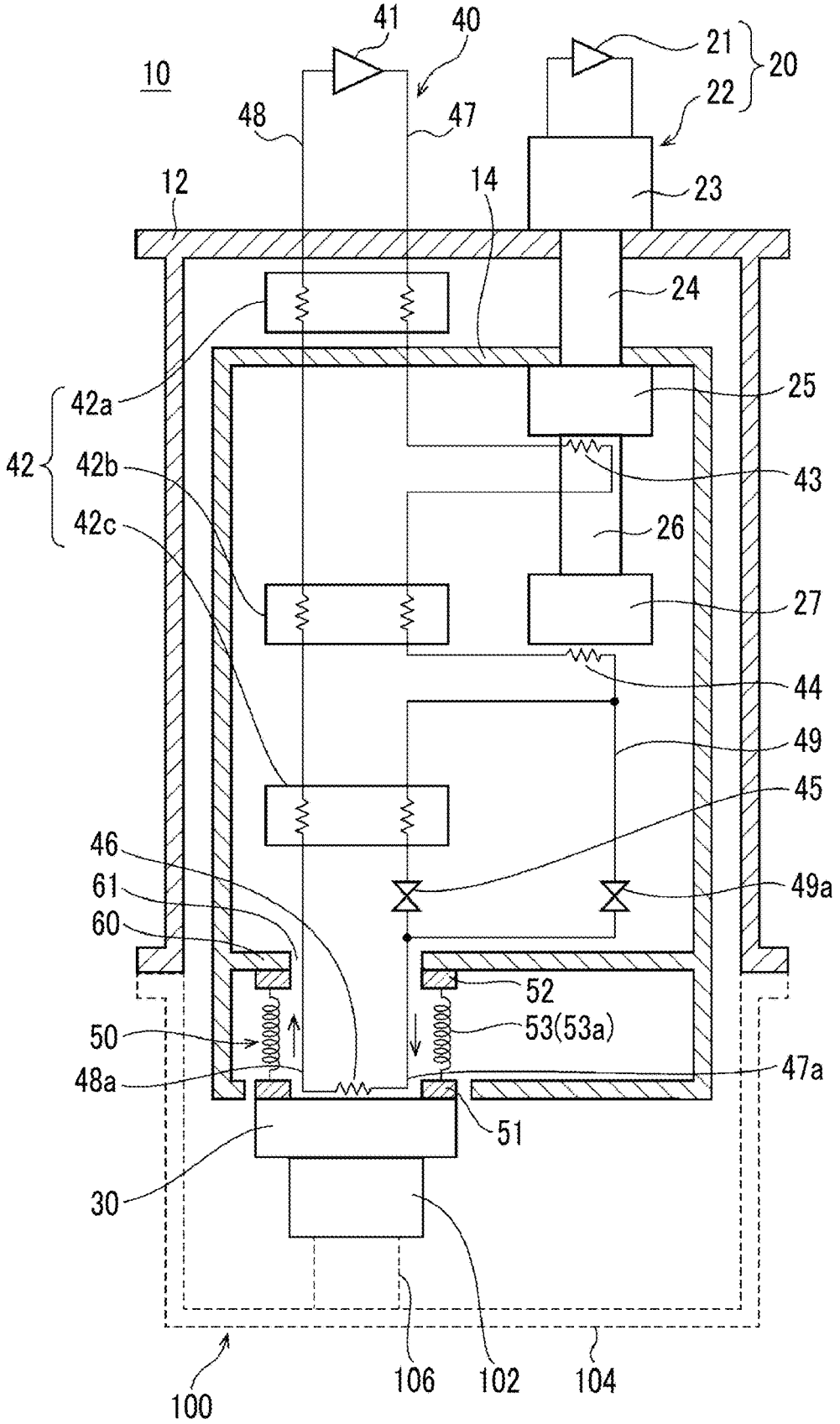
FIG. 1 is a diagram schematically showing a cryogenic cooling device according to an embodiment.

In the refrigerant circulation type cryogenic cooling device having a cooling stage as described above, in many cases, the object to be cooled and the cooling stage are connected to each other by a flexible heat transfer member such as a foil or a bellows. Relative displacement between the object to be cooled and the cooling stage that can be caused by thermal contraction due to cooling can be absorbed by the flexible heat transfer member. In this manner, it is possible to prevent an excessive stress from acting in the cooling device, for example, in a refrigerant pipe connecting the cooling stage and the cryocooler. However, there is a disadvantage in that a temperature difference occurs between the cooling stage and the object to be cooled due to a heat flux and heat conduction via the flexible heat transfer member. That is, the object to be cooled can be cooled only to a temperature somewhat higher than a temperature of the cooling stage. This disadvantage is eliminated or alleviated by directly fixing the object to be cooled and the cooling stage to each other or connecting them to each other with a rigid heat transfer member. However, in this case, there is a concern about the risk of a stress in the cooling device and the damage or failure of the device caused by the stress.

It is desirable to provide a cryogenic cooling device that prevents generation of an excessive thermal stress in the device and enables efficient cooling of an object to be cooled.

Embodiments of the present invention will be described in detail below with reference to the drawings. The same or equivalent components, members, and processing in the description and the drawings will be denoted by the same reference numerals and the repeated description thereof will be appropriately omitted. The scale and shape of each part to be shown are conveniently set to facilitate the description, and are not interpreted in a limited way as long as not particularly mentioned. The embodiments are exemplary and do not limit the scope of the present invention in any way. All features or combinations thereof described in the embodiments are not essential to the invention.

Figure 2:
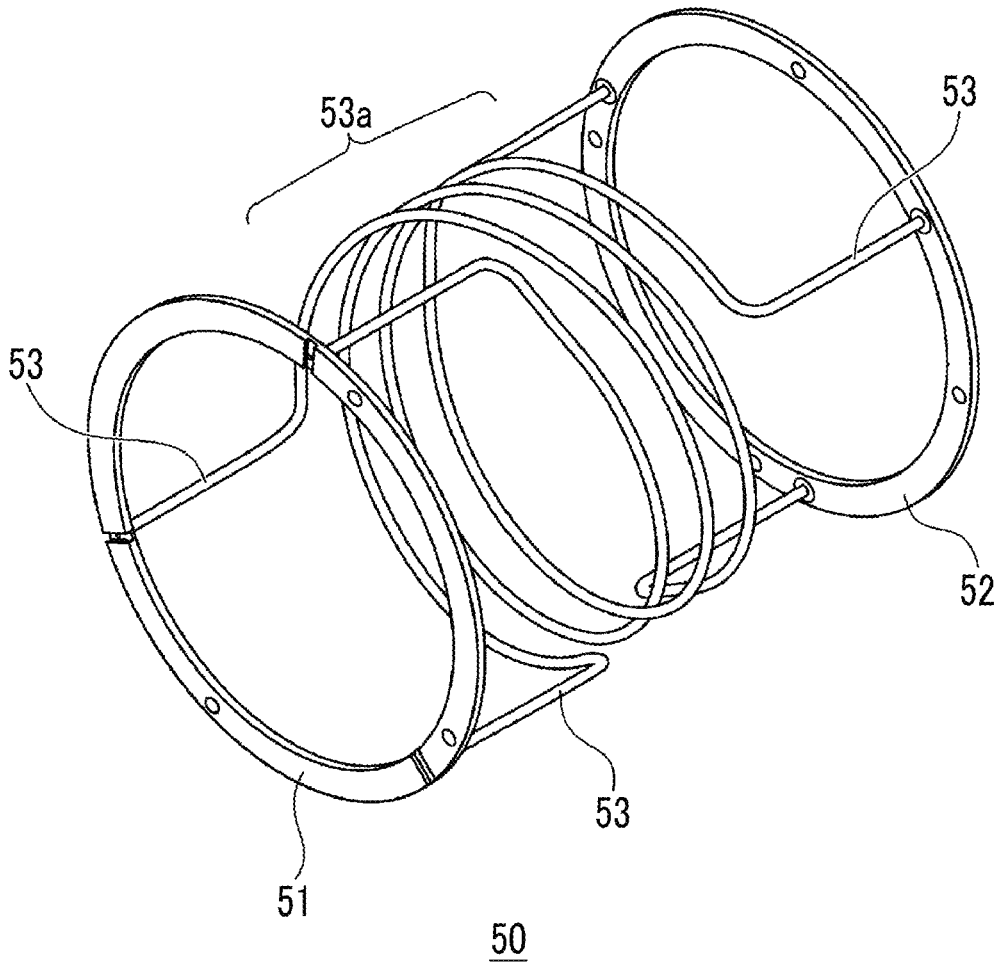
FIG. 2 is a perspective view schematically showing a cooling stage support member applicable to the cryogenic cooling device shown in FIG. 1.
Figure 3:
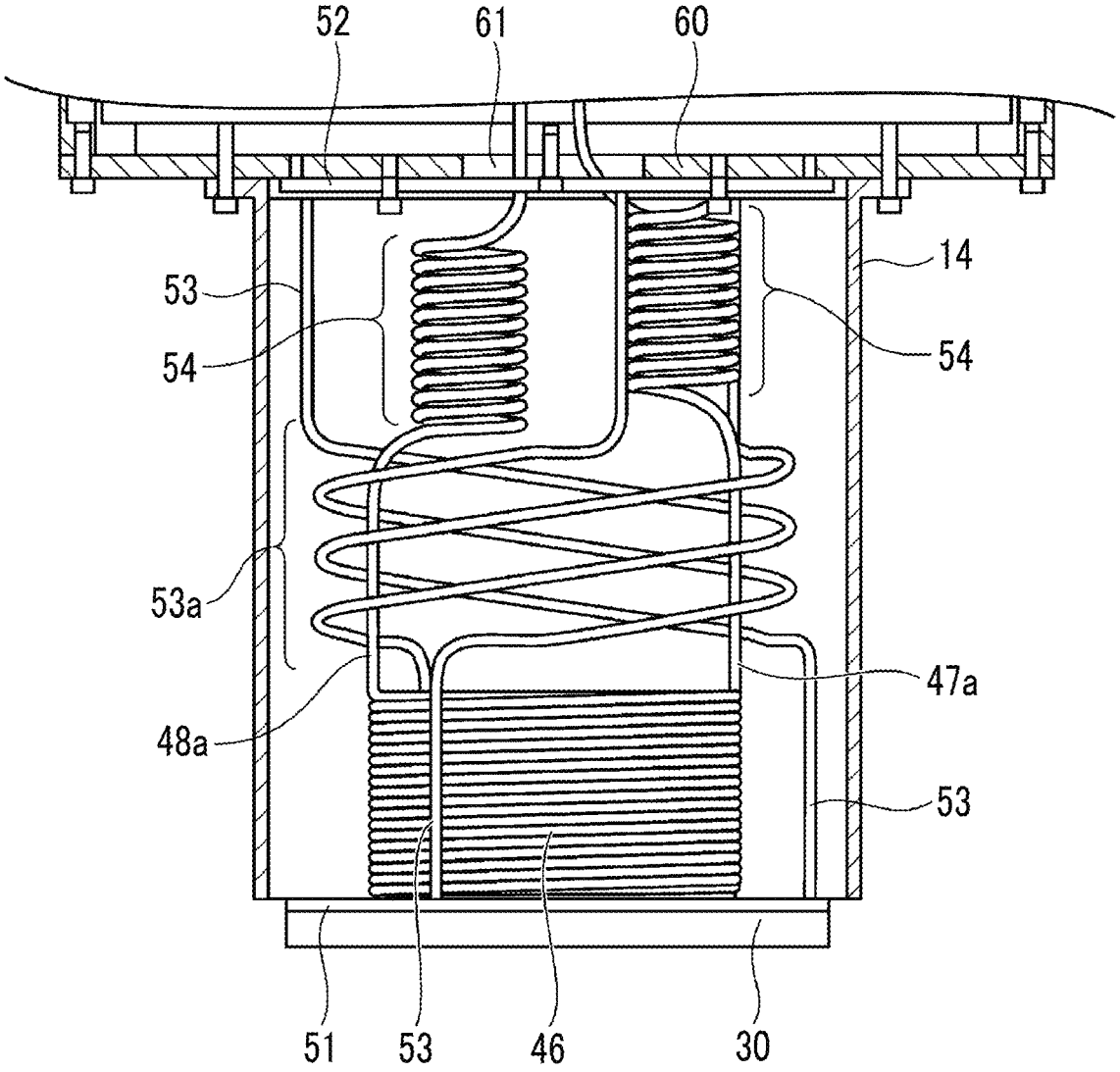
FIG. 3 is a side view schematically showing a cooling stage support structure in the cryogenic cooling device shown in FIG. 1.

FIG. 1 is a diagram schematically showing a cryogenic cooling device according to an embodiment. FIG. 2 is a perspective view schematically showing a cooling stage support member applicable to the cryogenic cooling device shown in FIG. 1. FIG. 3 is a side view schematically showing a cooling stage support structure in the cryogenic cooling device shown in FIG. 1.

The cryogenic cooling device 10 includes a vacuum chamber 12, a first-stage radiation shield 14, and a cooling system 16. The cooling system 16 includes a cryocooler 20, a cooling stage 30, and a refrigerant circulation circuit 40. The cooling stage 30 is disposed to be separated from the cryocooler 20. A refrigerant (for example, helium) flowing through the refrigerant circulation circuit 40 is precooled by the cryocooler 20 and is supplied to the cooling stage 30. The cooling stage 30 is cooled by the refrigerant. The refrigerant after the cooling is collected and cooled again by the cryocooler 20. In this way, the refrigerant circulates through the refrigerant circulation circuit 40. In the present embodiment, the cooling system 16 configures a Joule-Thomson (JT) cryocooler. An exemplary configuration of the cooling system 16 will be described later.

A cryogenic device 100 cooled by the cryogenic cooling device 10 includes an object 102 to be cooled. The object 102 to be cooled is, for example, superconducting equipment such as a superconducting coil, or other equipment that operates at a cryogenic temperature. The object 102 to be cooled is in physical contact with the cooling stage 30 and is thermally coupled to the cooling stage 30, or is thermally coupled to the cooling stage 30 via a heat transfer member. In order to achieve good heat transfer, for example, instead of using a flexible heat transfer member such as a foil or a bellows, the object 102 to be cooled is directly fixed to the cooling stage 30 or is connected to the cooling stage 30 by a rigid heat transfer member. The cooling stage can be cooled to, for example, a temperature range of approximately 4 K or lower (for example, 1 K to 4 K), and thus, the object 102 to be cooled can be cooled to the temperature range.

The cryogenic device 100 may include a vacuum chamber 104 shown by a broken line in FIG. 1, and the object 102 to be cooled may be supported by the vacuum chamber 104 via a support body (for example, a support body made of an insulating material) 106. In order to suppress the heat intrusion to the object 102 to be cooled, the cryogenic device 100 may include a radiation shield (not shown) disposed in the vacuum chamber 104 to surround the object 102 to be cooled.

The vacuum chamber 12 of the cryogenic cooling device 10 is combined with the vacuum chamber 104 on a cryogenic device 100 side to provide a cryogenic vacuum environment in the vacuum chambers. The vacuum chamber 12 is also referred to as a cryostat. The vacuum chamber 12 is formed of a metal material such as stainless steel, for example, or another suitable high-strength material to withstand ambient pressure (for example, atmospheric pressure). The first-stage radiation shield 14 and a low-temperature section of the cooling system 16 are disposed in the vacuum chamber 12.

The first-stage radiation shield 14 is disposed to surround the low-temperature section of the cooling system 16, is cooled to a temperature (a first cooling temperature to be described later, for example, approximately 80 K) higher than that of the cooling stage 30 by the cryocooler 20, and suppresses intrusion of the radiant heat from the vacuum chamber 12 to the cooling system 16. The first-stage radiation shield 14 is formed of a high thermal conductivity metal material such as copper (for example, pure copper). An insulator such as a multi-layer insulator may be disposed between the vacuum chamber 12 and the first-stage radiation shield 14.

The cryocooler 20 is a two-stage Gifford-McMahon (GM) cryocooler, and includes a first compressor 21 and an expander 22 that is also referred to as a cold head. The expander 22 includes a room-temperature section 23, a first cylinder 24, a first precooling stage 25, a second cylinder 26, and a second precooling stage 27. The first compressor 21 is disposed outside the vacuum chamber 12. The expander 22 is installed in the vacuum chamber 12 such that the room-temperature section 23 is disposed outside the vacuum chamber 12 and the cylinders and the precooling stages are disposed inside the vacuum chamber 12.

The first cylinder 24 connects the first precooling stage 25 to the room-temperature section 23, and thereby, the first precooling stage 25 is structurally supported by the room-temperature section 23. The second cylinder 26 connects the second precooling stage 27 to the first precooling stage 25, and thereby, the second precooling stage 27 is structurally supported by the first precooling stage 25. The first cylinder 24 and the second cylinder 26 extend coaxially, and the room-temperature section 23, the first cylinder 24, the first precooling stage 25, the second cylinder 26, and the second precooling stage 27 are linearly arranged in a line in this order. Typically, the first precooling stage 25 and the second precooling stage 27 are formed of a high thermal conductivity metal material such as copper (for example, pure copper), and the first cylinder 24 and the second cylinder 26 are formed of other metal materials such as stainless steel.

A first displacer and a second displacer (not shown) are disposed to be capable of reciprocating in an inside of each of the first cylinder 24 and the second cylinder 26. A first regenerator and a second regenerator (not shown) are incorporated in the first displacer and the second displacer, respectively. In addition, the room-temperature section 23 has a drive mechanism (not shown) such as a motor for reciprocating the first displacer and the second displacer. The drive mechanism includes a flow path switching mechanism that switches a flow path of a refrigerant gas such that supply and exhaust of the refrigerant gas to and from an inside of the expander 22 is periodically repeated. The refrigerant gas is usually a helium gas, but another appropriate gas may be used.

The first compressor 21 is configured to collect the refrigerant gas from the expander 22, to pressurize the collected refrigerant gas, and to supply the refrigerant gas to the expander 22 again. By circulating the refrigerant gas between the first compressor 21 and the expander 22 with a combination of an appropriate pressure fluctuation and an appropriate volume fluctuation of the refrigerant gas in the expander 22, a thermodynamic cycle generating a cold temperature is configured, and the expander 22 can provide cryogenic cooling.

The first precooling stage 25 is cooled to the first cooling temperature, and the second precooling stage 27 is cooled to a second cooling temperature lower than the first cooling temperature. The first cooling temperature may be selected from, for example, a temperature range of 50 K or higher and 150 K or lower. The first cooling temperature may be, for example, in a temperature range of 80 K or higher and 120 K or lower. The second cooling temperature may be selected from, for example, a temperature range of 10 K or higher and 25 K or lower. The second cooling temperature may be, for example, in a temperature range of 15 K or higher and 20 K or lower.

The first-stage radiation shield 14 is in physical contact with the first precooling stage 25 and is thermally coupled to the first precooling stage 25 or is thermally coupled to the first precooling stage 25 via a heat transfer member. Therefore, the first-stage radiation shield 14 is cooled to the first cooling temperature.

The refrigerant circulation circuit 40 includes a second compressor 41, a heat exchanger group 42, a first-stage precooling portion 43, a second-stage precooling portion 44, a JT valve 45, a final heat exchanger 46, a refrigerant supply line 47 and a refrigerant collection line 48 that connect these components to each other. The refrigerant circulation circuit 40 is not limited to the specific configuration described herein and can adopt various typical configurations as appropriate.

The second compressor 41 is configured to pressurize the refrigerant gas collected from the refrigerant collection line 48 to send the collected refrigerant gas to the refrigerant supply line 47. The second compressor 41 serves as a refrigerant source that circulates the refrigerant in the refrigerant circulation circuit 40. The second compressor 41 is disposed outside the vacuum chamber 12.

The heat exchanger group 42 in the refrigerant circulation circuit 40 is disposed between the second compressor 41 and the final heat exchanger 46. The heat exchanger group 42 is composed of a series of counterflow heat exchangers (42*a* to 42*c*), and in the present embodiment, has a three-stage configuration of a first heat exchanger 42*a*, a second heat exchanger 42*b*, and a third heat exchanger 42*c*. The first heat exchanger 42*a* is disposed between the vacuum chamber 12 and the first-stage radiation shield 14, that is, a space inside the vacuum chamber 12 and outside the first-stage radiation shield 14. The second heat exchanger 42*b*, the third heat exchanger 42*c*, and the final heat exchanger 46 are disposed inside the first-stage radiation shield 14. The heat exchanger group 42 may have another multi-stage configuration.

The first heat exchanger 42*a* cools a high-temperature (for example, a room temperature, for example, approximately 300 K) refrigerant gas flowing into the vacuum chamber 12 from the outside of the vacuum chamber 12. The second heat exchanger 42*b* further cools the refrigerant cooled by the first heat exchanger 42*a* and the first-stage precooling portion 43. The third heat exchanger 42*c* further cools the refrigerant cooled by the second heat exchanger 42*b* and the second-stage precooling portion 44.

The refrigerant supply line 47 connects an exhaust side of the second compressor 41 to a supply side of the final heat exchanger 46, and the refrigerant collection line 48 connects a collection side of the final heat exchanger 46 to a suction side of the second compressor 41. For understanding, a direction in which the refrigerant flows is indicated by an arrow in FIG. 1. The refrigerant supply line 47 has a high pressure side flow path of each of the first heat exchanger 42*a*, the second heat exchanger 42*b*, and the third heat exchanger 42*c*, and the refrigerant collection line 48 has a low pressure side flow path of each of the first heat exchanger 42*a*, the second heat exchanger 42*b*, and the third heat exchanger 42*c*. The refrigerant flowing through the high pressure side flow path can be cooled by heat exchange between the high pressure side flow path and the low pressure side flow path in each heat exchanger. The high pressure side flow path and the low pressure side flow path may be referred to as a high temperature side flow path and a low temperature side flow path, respectively.

The first-stage precooling portion 43 is thermally coupled to the first precooling stage 25 of the cryocooler 20. The first-stage precooling portion 43 is disposed between the first heat exchanger 42*a* and the second heat exchanger 42*b* in the refrigerant supply line 47. The refrigerant flowing through the first-stage precooling portion 43 is cooled by the first precooling stage 25.

The second-stage precooling portion 44 is thermally coupled to the second precooling stage 27 of the cryocooler 20. The second-stage precooling portion 44 is disposed between the second heat exchanger 42*b* and the third heat exchanger 42*c* in the refrigerant supply line 47. The refrigerant flowing through the second-stage precooling portion 44 is cooled by the second precooling stage 27.

The JT valve 45 is disposed between the last heat exchanger of the heat exchanger group 42 (in the present example, the third heat exchanger 42*c*) and the final heat exchanger 46 in the refrigerant supply line 47. The JT valve 45 is, for example, a fixed orifice.

The refrigerant supply line 47 includes a supply pipe 47*a* that supplies the refrigerant cooled by the cryocooler 20 to the final heat exchanger 46, and the refrigerant collection line 48 includes a collection pipe 48*a* that collects the refrigerant from the final heat exchanger 46. As shown in FIG. 1, the supply pipe 47*a* connects the JT valve 45 to a refrigerant inlet of the final heat exchanger 46, and the collection pipe 48*a* connects a refrigerant outlet of the final heat exchanger 46 to the third heat exchanger 42*c*.

In addition, the refrigerant supply line 47 includes a bypass path 49 that bypasses the JT valve 45, and the bypass path 49 includes a bypass valve 49*a*. As an example, the bypass path 49 branches from the refrigerant supply line 47 between the second-stage precooling portion 44 and the third heat exchanger 42*c*, and merges with the refrigerant supply line 47 again between the JT valve 45 and the final heat exchanger 46. The bypass valve 49*a* is, for example, a gas pressure-driven on-off valve. The bypass valve 49*a* may be an electromagnetic type on-off valve, a mechanical type on-off valve, a manual type on-off valve, or an on-off valve of another driving type.

The refrigerant flows through the bypass path 49 when the bypass valve 49*a* is opened, and the refrigerant flows through the JT valve 45 when the bypass valve 49*a* is closed. The bypass valve 49*a* is opened to precool the refrigerant circulation circuit 40 by using the cryocooler 20 at the time of starting the refrigerant circulation circuit 40. The bypass valve 49*a* is closed during a steady operation of the refrigerant circulation circuit 40.

In the steady operation of the refrigerant circulation circuit 40, the refrigerant flows through the refrigerant circulation circuit 40 as follows. The high-pressure refrigerant compressed by the second compressor 41 is first supplied to the high pressure side flow path of the first heat exchanger 42*a*. The high-pressure refrigerant flowing through the high pressure side flow path of the first heat exchanger 42*a* is cooled by heat exchange with the returning low-pressure refrigerant flowing through the low pressure side flow path of the first heat exchanger 42*a*. The high-pressure refrigerant cooled by the first heat exchanger 42*a* flows into the first-stage precooling portion 43 through the refrigerant supply line 47.

The high-pressure refrigerant is cooled by the first precooling stage 25 of the cryocooler 20 in the first-stage precooling portion 43 and is fed into the high pressure side flow path of the second heat exchanger 42*b*. The high-pressure refrigerant flowing through the high pressure side flow path of the second heat exchanger 42*b* is cooled by heat exchange with the returning low-pressure refrigerant flowing through the low pressure side flow path of the second heat exchanger 42*b*. The high-pressure refrigerant cooled by the second heat exchanger 42*b* flows into the second-stage precooling portion 44 through the refrigerant supply line 47.

The high-pressure refrigerant is cooled by the second precooling stage 27 of the cryocooler 20 in the second-stage precooling portion 44, and is fed into the high pressure side flow path of the third heat exchanger 42*c*. The high-pressure refrigerant flowing through the high pressure side flow path of the third heat exchanger 42*c* is cooled by heat exchange with the returning low-pressure refrigerant flowing through the low pressure side flow path of the third heat exchanger 42*c*. In this way, the high-pressure refrigerant is cooled to a temperature at which the Joule-Thomson effect is expected or lower, and is sent to the JT valve 45.

When the cooled high-pressure refrigerant passes through the JT valve 45, the cooled high-pressure refrigerant becomes a low-pressure refrigerant in a mist-like gas-liquid mixed state via the Joule-Thomson effect, and generates a cooling capacity in a temperature range of the liquefied refrigerant. The mist-like low-pressure refrigerant is sent to the final heat exchanger 46. As described above, in a case where the refrigerant is helium, the final heat exchanger 46 can be cooled to the liquid helium temperature range. The final heat exchanger 46 can cool the cooling stage 30 to the temperature by heat exchange between the refrigerant and the cooling stage 30.

When the final heat exchanger 46 is cooled, the mist-like low-pressure refrigerant evaporates to vaporize again. The refrigerant that is not liquefied and the refrigerant that is vaporized by evaporation in the JT valve 45 are returned to the low pressure side flow path of the third heat exchanger 42*c*. The low-pressure refrigerant flows through the refrigerant collection line 48 in the order of the second heat exchanger 42*b* and the first heat exchanger 42*a*. In this case, the low-pressure refrigerant is heated while cooling the high-pressure refrigerant in each of the heat exchangers (42*c*, 42*b*, 42*a*) as described above. In this way, the low-pressure refrigerant that has returned to the room temperature exits the vacuum chamber 12, is collected by the second compressor 41, and is compressed again.

In this way, the cryogenic cooling device 10 can cool the cooling stage 30 and the object 102 to be cooled to a desired temperature lower than the second cooling temperature of the cryocooler 20, for example, approximately 4 K or lower (for example, 1 K to 4 K).

The cryocooler 20 and the refrigerant circulation circuit 40 are fluidly isolated from each other. That is, the flow path of the refrigerant gas flowing inside the cryocooler 20 and the refrigerant circulation circuit 40 are completely separated from each other, and the refrigerant gas of the cryocooler 20 and the refrigerant of the refrigerant circulation circuit 40 are not mixed with each other.

Incidentally, the cooling stage 30 is rigidly connected to the object 102 to be cooled in order to efficiently cool the object 102 to be cooled as described above. With the cryogenic cooling in the cryogenic cooling device 10 and the cryogenic device 100, thermal contraction and corresponding displacement can occur in various components of these devices. In particular, since the cooling stage 30 is integrated with the object 102 to be cooled, the cooling stage 30 can be displaced to be pulled to the cryogenic device 100 side (downward in FIG. 1) by thermal contraction in the cryogenic device 100. In addition, the refrigerant circulation circuit 40 connected to the cooling stage 30 can thermally contract such that the cooling stage 30 is pulled to a cryogenic cooling device 10 side (upward in FIG. 1). Therefore, a stress corresponding to a tensile force thereof can act on the components in the cryogenic cooling device 10, such as the refrigerant circulation circuit 40 and the cryocooler 20 connected thereto. In a case where a stress exceeding an allowable stress acts because of excessive thermal contraction, there is a risk that the cryogenic cooling device 10 may be damaged or may fail.

A refrigerant pipe forming the refrigerant circulation circuit 40 is generally formed of pure copper for good heat conduction. Since pure copper has lower strength as compared to other metal materials such as stainless steel that is used often as a structural material, the pure copper may be significantly deformed by the excessive stress or may be damaged in the worst case.

The above-described deformation or damage is reduced when the cooling stage 30 and the object 102 to be cooled are connected to each other with a flexible heat transfer member such as a foil or a bellows. However, in this case, there is a concern that a significant temperature difference may occur between the cooling stage 30 and the object 102 to be cooled, being caused by a heat flux and heat conduction via the flexible heat transfer member, and cooling efficiency may be reduced.

Regarding that, in the present embodiment, a cooling stage support member 50 is provided in the cryogenic cooling device 10. The cooling stage support member 50 connects the cooling stage 30 to a fixation portion 60 such that displacement of the cooling stage 30 with respect to the fixation portion 60 is allowed. As will be described later, the cooling stage support member 50 connects the cooling stage 30 and the fixation portion 60 to each other such that movement of the cooling stage 30 in a direction in which the cooling stage 30 moves away from the fixation portion 60 is enabled. In this way, the cooling stage 30 is supported by the fixation portion 60 via the cooling stage support member 50.

In the present embodiment, the fixation portion 60 is provided in the first-stage radiation shield 14. In this way, the fixation portion 60 is fixed with respect to the cryocooler 20. The cooling stage support member 50 is cooled to the first cooling temperature via the fixation portion 60 (that is, the first-stage radiation shield 14). Therefore, the intrusion heat from the cooling stage support member 50 to the cooling stage 30 and the refrigerant circulation circuit 40 can be reduced as compared to a case where the cooling stage support member 50 is maintained at an ambient temperature (for example, room temperature).

The cooling stage support member 50 includes a first end 51 fixed to the cooling stage 30, a second end 52 fixed to the fixation portion 60, and at least one support rod 53 connecting the first end 51 and the second end 52 to each other.

A first end 51 of the cooling stage support member 50 is fixed to, for example, an outer periphery of the cooling stage 30 to surround the final heat exchanger 46. As illustrated in FIG. 3, the final heat exchanger 46 may be a coil-shaped refrigerant pipe, and may be referred to as a stage cooling coil. The cooling stage 30 may include a columnar main body portion and a disk-shaped flange portion extending outward in a radial direction from an end portion (lower end in FIG. 3) of the main body portion, and the main body portion and the flange portion may be integrally formed. A coil-shaped pipe that forms the final heat exchanger 46 is wound around a side surface of the main body portion and is fixed to the cooling stage 30, and the final heat exchanger 46 cannot be relatively displaced with respect to the cooling stage 30. A first end 51 of the cooling stage support member 50 is fixed to a surface (upper surface) of the flange portion on a main body portion side, and the object 102 to be cooled is fixed to a surface (lower surface) on an opposite side. The first end 51 is, for example, an annular member disposed along the outer periphery of the cooling stage 30, and is fixed to the cooling stage 30 by a fastening member such as a bolt.

The second end 52 of the cooling stage support member 50 is fixed to the fixation portion 60 to surround the refrigerant circulation circuit 40. The fixation portion 60 is provided with an opening portion 61 for passing the supply pipe 47*a* and the collection pipe 48*a* of the refrigerant circulation circuit 40, and the second end 52 may be fixed to an outer periphery of the opening portion 61. The second end 52 is, for example, an annular member having the same diameter as the first end 51, and is fixed to the fixation portion 60 by a fastening member such as a bolt.

In this example, the cooling stage support member 50 has a plurality (for example, three) of support rods 53. The plurality of support rods 53 are disposed at equal intervals in a circumferential direction, and each of the plurality of support rods 53 connects the first end 51 and the second end 52 to each other. The support rod 53 is a solid rod or a hollow pipe.

The support rod 53 includes a coil-shaped portion 53*a* that expands and contracts in accordance with the displacement of the cooling stage 30 with respect to the fixation portion 60. The coil-shaped portion 53*a* is spirally curved to surround the supply pipe 47*a* and the collection pipe 48*a* of the refrigerant circulation circuit 40, and is elastically expandable and contractible in the extending direction of the pipes. Therefore, the cooling stage 30 can move in a direction away from the fixation portion 60 (or in a direction close to the fixation portion 60) with the expansion and contraction of the coil-shaped portion 53*a*. By appropriately setting a material and a shape (for example, a cross-sectional area, a winding pitch, and the number of windings) of the coil-shaped portion 53*a*, flexibility (allowable amount of displacement), stiffness (natural frequency), and an amount of heat intrusion of the cooling stage support member 50 can be designed as desired.

A displacement absorption portion 54 that absorbs the displacement of the cooling stage 30 with respect to the fixation portion 60 is formed in each of the supply pipe 47*a* and the collection pipe 48*a*. The displacement absorption portion 54 of the supply pipe 47*a* is formed in the supply pipe 47*a* by curving a part of the supply pipe 47*a* in a spiral shape, and the displacement absorption portion 54 of the collection pipe 48*a* is formed in the collection pipe 48*a* by curving a part of the collection pipe 48*a* in a spiral shape. Therefore, the displacement absorption portion 54 is elastically expandable and contractible in accordance with the expansion and contraction of the coil-shaped portion 53*a*, and can absorb the displacement of the cooling stage 30 with respect to the fixation portion 60.

The coil-shaped portion 53*a* may have stiffness higher than that of the displacement absorption portion 54, with respect to a tensile load generated when the cooling stage 30 is displaced in a direction away from the fixation portion 60. Accordingly, it is possible to prevent an excessive stress from acting on the displacement absorption portion 54. For example, this may be achieved by forming the coil-shaped portion 53*a* of stainless steel and forming the supply pipe 47*a* and the collection pipe 48*a* of pure copper.

Thermal conductivity of a material for forming the cooling stage support member 50 may be lower than thermal conductivity of a material for forming the refrigerant circulation circuit 40. The refrigerant circulation circuit 40 is formed of a high thermal conductivity metal material such as copper (for example, pure copper) as described above. In this case, the cooling stage support member 50 may be formed of a metal material such as stainless steel (for example, austenitic stainless steel) or a titanium alloy (for example, Ti-6Al-4V), or a synthetic resin material such as engineering plastic. In this way, the intrusion of heat to the cooling stage 30 through the cooling stage support member 50 can be reduced. In addition, it is easy to ensure strength of the cooling stage support member 50.

According to the present embodiment, the cooling stage 30 is supported by the cooling stage support member 50 to the fixation portion 60 such that the cooling stage 30 is allowed to be displaced with respect to the fixation portion 60. Therefore, even when thermal contraction due to cryogenic cooling occurs, the relative displacement of the cooling stage 30 is allowed, and excessive thermal stress can be prevented from acting on the components in the cryogenic cooling device 10 such as the refrigerant circulation circuit 40. Therefore, the object 102 to be cooled can be directly connected to the cooling stage 30, the temperature difference between the object 102 to be cooled and the cooling stage 30 can be minimized, and the object 102 to be cooled can be efficiently cooled by the cooling stage 30. In addition, the cooling stage support member 50 is also useful for preventing deformation or damage of the refrigerant circulation circuit 40 that may occur during the transportation of the cryogenic cooling device 10 because of an own weight of the cooling stage 30.

The present invention has been described above based on the examples. It will be understood by those skilled in the art that the present invention is not limited to the above embodiments, various design changes can be made, various modification examples are possible, and such modification examples are also within the scope of the present invention. Various features described in relation to an embodiment are also applicable to other embodiments. New embodiments resulting from combinations have the effect of each of embodiments which are combined.

In the above-described embodiment, the cooling stage support member 50 has the coil-shaped portion 53*a*. However, instead of this, the cooling stage support member 50 may have another shape that is expandable and contractible in accordance with the displacement of the cooling stage 30 with respect to the fixation portion 60. For example, the support rod 53 of the cooling stage support member 50 may have a zigzag-shaped curved portion. The same applies to the displacement absorption portion 54.

The fixation portion 60 to which one end of the cooling stage support member 50 is fixed may be provided in the vacuum chamber 12 instead of the first-stage radiation shield 14. Alternatively, the cryogenic cooling device 10 may include a second-stage radiation shield that is cooled to a temperature lower than that of the first-stage radiation shield 14, and the fixation portion 60 may be provided in the second-stage radiation shield. The second-stage radiation shield may be thermally coupled to the second precooling stage 27 of the cryocooler 20 and may be cooled to the second cooling temperature by the second precooling stage 27.

The cryocooler 20 is not limited to a GM cryocooler. The cryocooler 20 may be a cryocooler of another type such as a pulse tube cryocooler or a Stirling cryocooler.

In addition, the cooling system 16 is not limited to a JT cryocooler. The cooling system 16 may be a refrigerant circulation type cooling system in which the refrigerant cooled by the cryocooler 20 is supplied to the cooling stage 30. In this case, the refrigerant circulation circuit 40 may not include the JT valve 45.

The present invention has been described using specific terms and phrases, based on the embodiments. However, the embodiments show only one aspect of the principles and applications of the present invention, and in the embodiments, many modifications or disposition changes are permitted within a scope which does not depart from the ideas of the present invention defined in the claims.

The present invention can be used in a field of cryogenic cooling devices.

It should be understood that the invention is not limited to the above-described embodiment, but may be modified into various forms on the basis of the spirit of the invention. Additionally, the modifications are included in the scope of the invention.

What is claimed is:

1. A cryogenic cooling device comprising:

a cooling system including a cryocooler that includes a precooling stage configured to cool a refrigerant, a cooling stage that is disposed to be separated from the precooling stage, and a refrigerant circulation circuit configured to cool the cooling stage with the refrigerant;

a fixation portion that is fixed with respect to the precooling stage, is thermally coupled to the precooling stage, and is cooled by the precooling stage; and a cooling stage support member that connects the cooling stage to the fixation portion such that displacement of the cooling stage with respect to the fixation portion is allowed.

2. The cryogenic cooling device according to claim 1, wherein the cooling stage support member includes a coil-shaped portion that expands and contracts in accordance with the displacement of the cooling stage with respect to the fixation portion.

3. The cryogenic cooling device according to claim 1, wherein the refrigerant circulation circuit includes a heat exchanger configured to cool the cooling stage by heat exchange between the refrigerant and the cooling stage, a supply pipe configured to supply the refrigerant cooled by the cryocooler to the heat exchanger, and a collection pipe configured to collect the refrigerant from the heat exchanger, and a displacement absorption portion configured to absorb the displacement of the cooling stage with respect to the fixation portion is formed in each of the supply pipe and the collection pipe.

4. The cryogenic cooling device according to claim 3, wherein the cooling stage support member has a first stiffness higher than a second stiffness of the displacement absorption portion.

5. The cryogenic cooling device according to claim 3, wherein the cooling stage support member is disposed to surround the supply pipe and the collection pipe.

6. The cryogenic cooling device according to claim 1, wherein a first thermal conductivity of a material for forming the cooling stage support member is lower than a second thermal conductivity of a material for forming the refrigerant circulation circuit.

7. The cryogenic cooling device according to claim 1, wherein the cooling stage support member connects the cooling stage and the fixation portion to each other such that movement of the cooling stage in a direction in which the cooling stage moves away from the fixation portion is enabled.

8. The cryogenic cooling device according to claim 1, further comprising:

a radiation shield cooled by the precooling stage and configured to suppress heat intrusion to the cooling system, wherein the fixation portion is provided in the radiation shield.

9. The cryogenic cooling device according to claim 1, wherein the cooling stage is rigidly connected to an object to be cooled.

10. The cryogenic cooling device according to claim 1, wherein the cooling system configures a Joule-Thomson (JT) cryocooler.

11. The cryogenic cooling device according to claim 1, wherein the cooling stage support member includes a first end fixed to the cooling stage, a second end fixed to the fixation portion, and at least one support rod that connects the first end and the second end to each other and allows the displacement of the cooling stage with respect to the fixation portion.

* * * * *